United States Patent [19]

Engeli

[11] 3,984,060

[45] Oct. 5, 1976

[54] APPARATUS TO TEST FOR THE PRESENCE OF ONE ONLY THREAD IN TEXTILE MACHINES

[75] Inventor: Ernst Engeli, Au, Switzerland

[73] Assignee: Maschinenfabrik Schweiter AG, Horgen, Switzerland

[22] Filed: Feb. 14, 1975

[21] Appl. No.: 549,898

[30] Foreign Application Priority Data

Mar. 18, 1974 Switzerland ..... 3718/74

[52] U.S. Cl. ..... 242/36; 242/35.6 R

[51] Int. Cl.[2] ..... B65H 54/22

[58] Field of Search ..... 242/36, 37, 35.5 R, 242/35.6 R, 35.6 E; 28/64; 289/1.5, 2, 5, 18

[56] References Cited

UNITED STATES PATENTS

| | | | |
|---|---|---|---|
| 3,198,446 | 8/1965 | Furst et al. | 242/35.6 R |
| 3,220,758 | 11/1965 | Raasch et al. | 242/35.6 R X |
| 3,294,326 | 12/1966 | Raasch | 242/35.6 R |
| 3,599,886 | 8/1971 | Koller | 242/35.5 R |
| 3,801,031 | 4/1974 | Kamp et al. | 242/36 |

*Primary Examiner*—Stanley N. Gilreath
*Attorney, Agent, or Firm*—Flynn & Frishauf

[57] ABSTRACT

To determine if a thread pick-up device, to pick up broken or run-out thread in thread spooling machines, has located therein only a single strand of thread, the thread is passed through a test gap which provides pulses each time the test gap senses that a discrete strand of thread is passed therethrough, the pulses being applied to a counter, the counter controlling operation of the device so that, if a ONE count is received, the thread has been properly picked up; if no count, or more than one count have been received, the thread pick-up operation is controlled, for example, by repeating the pick-up operation, or cutting the thread at the end of the pick-up operation, and repeating, to ensure presence of only a single thread in the pick-up device. Sensing of the thread becomes, therefore, independent of yarn size, thickness, or localized changes in diameter.

11 Claims, 3 Drawing Figures

APPARATUS TO TEST FOR THE PRESENCE OF ONE ONLY THREAD IN TEXTILE MACHINES

Cross reference to related Patents: U.S. Pat. Nos. 3,380,677; 3,608,843; 3,934,716; all assigned to the assignee of the present application.

The present invention relates to textile machinery and more particularly to spooling machines in which broken, torn, or tail ends of spooled threads are being sensed so that these ends can be knotted or attached to further thread provided to the spooling machines; and specifically to method and apparatus to test if the pick-up apparatus has actually picked up an end, and only a single end of thread, and has done so properly, so that a knotting or tying operation will be carried out properly.

Textile machines, and particularly automatic spooling machines (see the cross-referenced Patents) are subject to the difficulty that, if yarn or thread being spooled tears, the ends of the threads cannot be reliably picked up so that upon re-connection of the torn or broken end with another thread, for example by knotting, such reconnection will not be a proper one. The most common error or defect in the re-connecting steps is the pick-up of a loop or double or multiple thread by the pick-up device at the respective spooling position of a multiple spindle spooling machine.

Various thread sensing devices have been proposed in order to eliminate difficulties arising upon pick-up of multiple threads. Such difficulties usually do not become apparent until subsequent manufacturing operations are carried out on the threads or yarn. One type of supervisory apparatus for thread pick-up devices is illustrated in Swiss Patent 480,254 (corresponding to German Publication Paper DT-AS 247,914 and U.S. Pat. No. 3,220,758; and U.S. Pat. No. 3,599,886 assigned to the assignee of this application). Yarn cleaning apparatus (see, for example, Swiss Patent 447,899; corresponding to U.S. Pat. No. 3,458,912, assigned to the assignee of this application) may be used, which have an optical or capacitative measuring cell, in which the cross-sectional area of all yarns passing through the measuring cell is determined. The resulting signal is evaluated to then determine if the ends of the threads have been properly picked up, have not been picked up, or have been picked up as multiple threads (for example as the results of loops, kinks, bights, or the like).

It has been found that measuring the dimensions of the picked up yarn, and then evaluating the sensed dimension to determine the number of yarns being picked up, has some disadvantages. One of the reasons seems to be that the thread frequently is subject to substantial irregularities regarding its cross-sectional structure, that is, it may have thinner and thicker portions which, however, may fall within the tolerance of the quality of the yarn being processed. Such irregularities in yarn thickness or yarn size then may lead to erroneous decisions by the sensing element, since the sensing cell cannot differentiate if a measured dimension corresponding, for example, to two normal thread diameters, is derived by a single thread which has a thickened diameter at the particular point, or is derived from three threads, each being sensed at an undersized portion. Additionally, dirt, fluff, and moisture may interfere with proper measuring; particularly, dirt and fluff interfere with optical measuring cells, and moisture, including ambient dampness, may additionally introduce errors when capacitative measuring or sensing cells are used.

It is an object of the present invention to provide a method, and an apparatus, in which the difficulties in determining proper pick-up of yarn ends, automatically, are eliminated.

Subject matter of the present invention: Briefly, rather than sensing for a dimensional quantity when measuring yarn being picked up, the algebraic number or algebraic count of discrete strands of thread is being determined.

In accordance with a feature of the invention, yarn is passed through a sensing or test zone, typically a test gap, which is connected to a switching stage to count the algebraic number of discrete strands of threads, or yarn filaments, sequentially passing through the zone, and to generate a corresponding number of count pulses.

The present invention is particularly applicable to multiple-spindle automatic spooling machines, having a large number of spooling positions (one, each, associated with a spindle) and a defect-sensing and clearing mechanism which can be associated with any one of the spooling positions. A sensing and test device is provided to test pick-up of broken threads, or yarn ends. The sensing and testing device includes a test zone, or gap, and a pick-up, for example a vacuum tube or nozzle, as well as a circuit arrangement to count the number of threads, or yarn, or filaments picked up by the pick-up (the vacuum nozzle) upon relative motion of the sensing and test device transverse to the ends of yarns extending from the spindle of the spooling machine towards the pick-up device or nozzle. The pulses generated by the sensing and test device upon such transverse movements then will be a measure of the number of threads which were picked up. If the count does not match a predetermined number, or exceeds a threshold level (for example a count of ONE), the defect-sensing and clearing mechanism automatically initiates corrective steps, for example repetition of the pick-up movement (if a count of ZERO has been registered), a cutting operation of all yarns which were picked up (if a count greater than ONE has been sensed) and re-initiation of the pick-up operation, or termination of the sensing operation, and stopping of spooling at the particular spooling position, coupled with an alarm indication to clear defects, for example by operating personnel.

The invention will be described by way of example with reference to the accompanying drawings, wherein.

Figure 1:
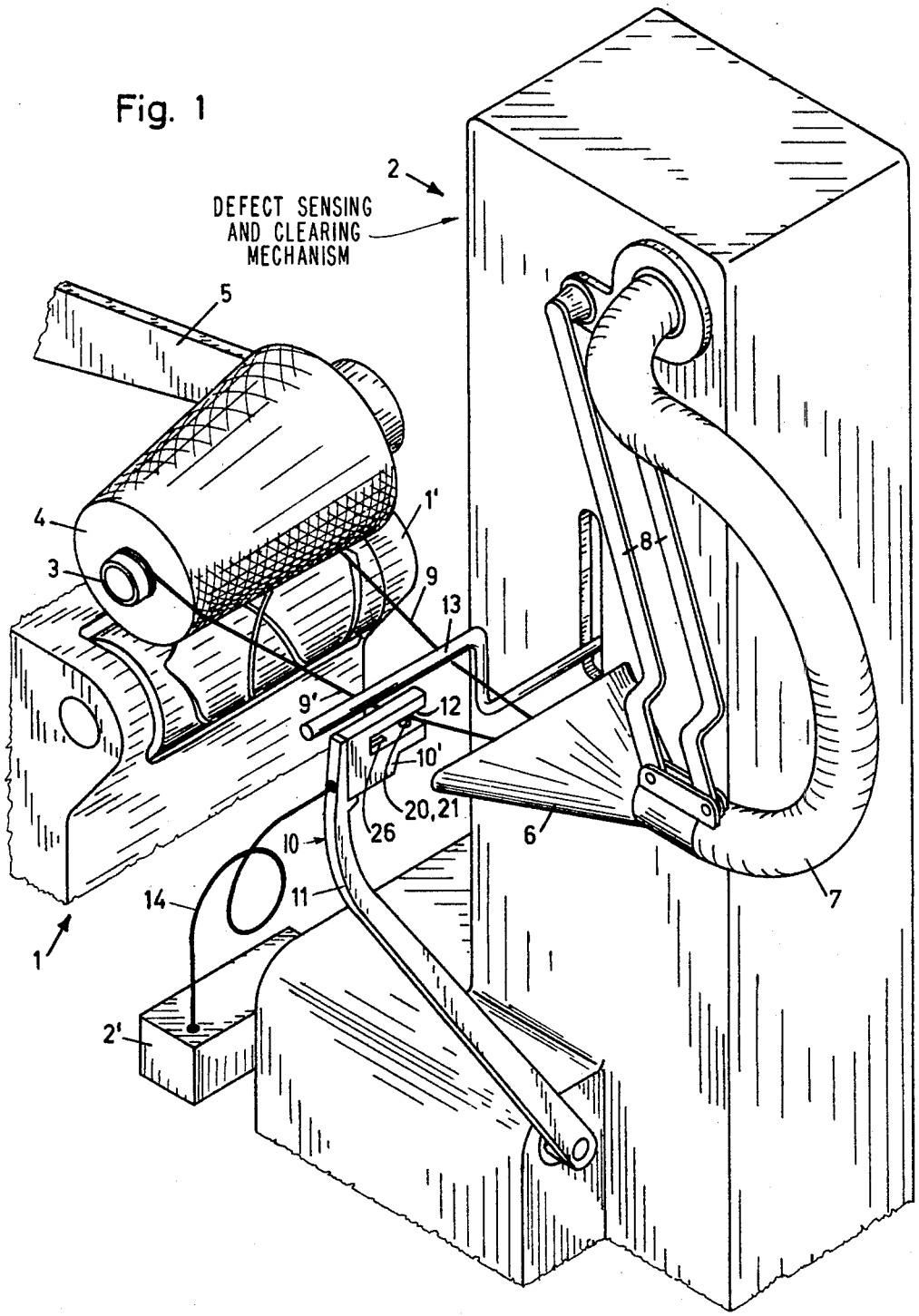
FIG. 1 is a perspective and schematic view of an apparatus to sense defects, and clear defects, and illustrating the apparatus, and useful in illustrating the method of the present invention, as applied to an automatic spooling machine for yarn packages.

A spooling machine, for example of the automatic, multiple-spindle type, and of which only a single spindle is illustrated, is generally shown at 1. The spooling machine has a defect-sensing and clearing apparatus 2, which includes a device to supervise the search or test operation for a broken or torn end of thread. The spooling position in the multiple spooling machine may be brought into cooperation with the search and clearing apparatus 2, for example when located on a rotating turret which is so controlled by a stop motion device that, when a broken thread is sensed at any particular spooling position, the turret is rotated to bring the particular spooling position in the cooperative relationship with the yarn sensing and pick-up device 2, as illustrated in FIG. 1. Multiple-spindle spooling machines have a large number of spooling positions. The thread sensing and clearing device may be associated with any one of the spooling positions by relative movement of the spooling positions and the clearing and pick-up device, in order to clear defects arising at any one of the spooling positions.

The construction of the spooling positions, of the spindles, and the like, to spool yarn, may be of any suitable, well-known type (see the cross-referenced Patents) and, besides elements not relevant to the understanding of the present invention, includes a rotating grooved roller 1' which drives a yarn spindle on which a cone 3 is attached so that yarn 4 will be wound thereon in package form. The package including cone or core 3, and yarn 4, is freely rotatably mounted on the free end of a package carrying arm 5.

The automatic defect-sensing and clearing mechanism has a suction nozzle 6 to search for and pick up the broken end of the thread from the package 4 of the spooling position 1. The suction nozzle 6 is connected by means of a pneumatic suction tube 7 to a vacuum pump (not shown) and is supported by a parallelogram linkage 8 in such a manner that it can move relative to the yarn package 4, on the core 3.

If a broken yarn is sensed by a stop-motion device, that is, if yarn should break as it is being spooled, for example, from a pirn unto the package 4, or the end of yarn should be reached, so that continuity of yarn being spooled on the package 4 is interrupted, then the particular spooling spindle position 1 is brought into operative alignment with the defect-sensing and clearing mechanism 2. This initiates a sequence of events, the first one of which is pivoting of the parallelogram linkage 8 to move the suction nozzle 6 towards the left in FIG. 1, that is, towards package 4 to pick up thread. The loose end of the broken or terminal end of thread of the package 4 is sucked into the suction nozzle 6. Such a loose or broken end is shown by thread 9. Controlled by a timer, or by the presence of thread or yarn in the suction nozzle 6, the parallel linkage 8 then returns to the position shown in FIG. 2. The thread end 9 is carried along by the nozzle 6, and introduced into the defect-sensing and clearing mechanism by being picked-up and spooled off the package 4. As soon as yarn is introduced into the suction nozzle 6, that is, has been picked up, the actual clearing of the defect can commence.

Properly clearing the defect — that is, knotting the free end 9 to the leading end lap of a new pirn, for example — requires that only one such free end 9 has been introduced into the pick-up device. In other words, the pick-up operation itself must be monitored.

Supervisory thread sensing device 10 is provided to monitor proper pick-up of the thread 9 by the pick-up nozzle 6. The supervisory apparatus 10 (FIG. 1) determines if the respective end 9 has been properly picked up, or if no thread end has been picked up, or if multiple strands of threads 9, as well as 9', have been picked up. This supervisory device 10, in accordance with the present invention, operates on a counting principle, as will be explained.

A pivot arm 11 is secured to the machine, for example to the defect-sensing and clearing mechanism as shown in FIG. 1, and holds at its end the thread counting head 10'. The thread counting head 10' is so secured to the pivot arm 11 that it moves essentially transversely to the threading direction of the thread 9 from the package 4 into the nozzle 6. The path of movement of the threading head 10' is so selected that it includes, preferably, that region in which not only the thread 9 can be expected but in which multiple threads such as thread 9' also, from experience, would be located, as clearly shown in FIG. 1. The specific location is selected at a point at which possible multiple threads 9 and 9' narrowly approach each other (FIG. 1). A thread-directing bail 13 is provided in order to place the threads uniformly into a single plane which corresponds at least approximately to the plane of movement of the head 10' and, essentially, to the plane of a measuring gap 12 formed in the head 10'. Thus, the supervisory or testing head 10' will sense threads 9, 9' sequentially as they pass through the gap 12. The thread-directing bail 13 is vertically movable, and guided in the housing of the defect-sensing and clearing mechanism 2.

Movements of the nozzle 6, the bail 13, and the arm 11, and hence of the sensing head 10', are synchronized with respect to each other by suitable sequencing and timing switching arrangements, by limit switches, or the like, as well known in connection with sequential operation of automatic production equipment.

Figure 2:
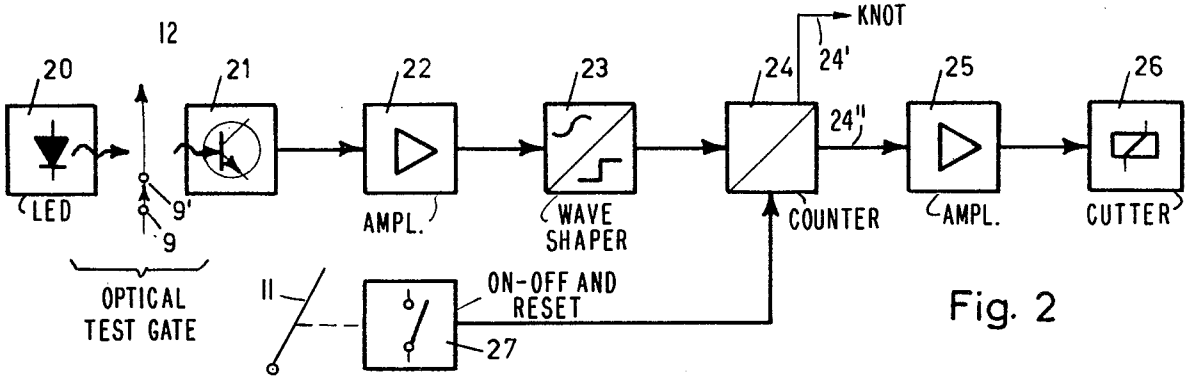
FIG. 2 is a block circuit diagram of a test and sensing device of the arrangement in accordance with FIG. 1.

FIG. 2 illustrates the thread supervisory apparatus 10 in greater detail. An optical test gate is arranged at opposite portions of the test gap 12, the gate comprising a light-emitting diode (LED) 20 and a photosensitive semi-conductor such as a photo transistor 21. The LED 20 is located at one side of the gap 12, the photo transistor 21 at the other, both being placed in light-transmitting relationship and adjacent the input or open end of the test gap 12 of the head 10'. Strands of threads 9', 9 which sequentially pass through the gap 12 then provide dark-pulses which are picked up as signals from the phototransistor 21 and applied to a subsequent amplifier 22. The output signals of amplifier 22 are applied to a wave-shaping circuit in form of a Schmitt trigger 23 which converts the output pulses from amplifier 22 into square wave pulses. These square wave pulses are applied to a counter 24. Counter 24 algebraically counts the pulses applied thereto. Preferably it is a standard electronic counter, so wired that signals can be obtained depending on the algebraic count number being recorded therein. If more than one count is recorded by the counter 24, a signal is applied to an amplifier 25 which provides an output signal to a thread cutting knife 26, located at the inner end of the gap 12 of the measuring head 10'. An ON-OFF-RESET switch 27 is provided which connects the counter and resets the counter, for example by erasing any counts stored therein. Operation of switch 27 is controlled by the defect-sensing and clearing mechanism and is interlocked with the sequencing thereof in such a manner that, after return of the parallel linkage 8 to the position in FIG. 1 (so that, presumably, threads 9 and possibly 9' are introduced therein), movement of link 11 and hence of sensing head 10' and gap 12 transverse to the threads is initiated and simultaneously the switch 27 is closed, permitting counting to commence. When the arm 11 has reached a terminal position, switch 27 opens and on the trailing pulse the counter 24 is reset to zero, ready for a subsequent test sequence. Erroneous indications are thereby reliably avoided.

Nozzle 6, moved by the linkage 8, sucks in ends of yarn or thread from the package 4. FIG. 1 illustrates a common occurrence in spooling machines, namely that a torn end of thread has wrapped itself around the end of the core 3 to form a stray loop. The suction nozzle 6 therefore has picked up two lengths of yarn 9, 9', both of which are sucked into the nozzle 6 upon return movement to the right (as shown in FIG. 1) thereof. As the nozzle 6 retreats towards the right, bail 13 is dropped to the position in FIG. 1 (for example under control of a cam coupled to the movement of linkage 8, electrically, or the like), so that the proper thread end 9 as well as the wrapped loop 9' located in a common plane, suitable for subsequent testing and supervision of the pick-up operation. As arm 11 swings towards the right, thread 9' will first pass through gap 12 and cause a pulse in the test gate 20, 21; next, thread 9 will be introduced into the gap 12 of the head 10' and will cause a second dark-pulse in the gate 20, 21. Relative movement between the threads and the counting head 10' is continued, that is, the arm 11 is pivoted to the right until a thread even at the far right side of the package is located at the inner end of the gap 12; as shown in FIG. 1, cutting knife 26 is located at that inner gap. Switch 27 has been closed upon initiation of movement of the arm 11, so that the counter 22 was energized and, as above described, has counted in excess of the count of ONE. Cutter 26 is thus energized, for example again by a limit switch associated with the arm 11 to determine that the arm 11 has reached its far end, and can sever both threads 9 and 9'. Arm 11 will then return to its initial position, and counter 24 will be reset.

Switch 27, which controls the counter 24, is preferably located in a portion 2' (FIG. 1) of the defect-sensing and clearing mechanism. Portion 2' also preferably includes a power supply to the thread counting head 10', and control wiring, conducted over a cable 14. The other circuit components, that is, amplifier 22, trigger 23 and amplifier 25 may likewise be located in the portion 2'. Preferably, the counting head 10 is formed as a single unitary assembly and located at the free end of arm 11, so that it is readily replaceable and exchangeable. The control signal for the cutter 26 can also be used to re-initiate a pick-up operation (repeated movement of linkage 8, and subsequent movement of arm 11, etc.), so that, if the first pick-up operation was unsuccessful in picking up a single yarn, a subsequent operation can be automatically initiated which, due to the severing of stray loop yarn, now may well pick up only the desired thread 9. The signal from counter 24, that a count other than ONE is present, may also be used for other purposes, for example to stop the spooling position, to give an alarm signal to supervisory personnel, or the like. A ONE count is available at line 24'.

The apparatus has been illustrated in connection with supervision and pick-up of the free yarn end from a yarn package in a package spooling machine. The same apparatus may, of course, also be applied to the supply spool, for example to a pirn rather than to the wind-up spool, as shown, or to any other winding device or system in textile machinery.

The apparatus and method of the present invention have the advantage that particular adjustment of the sensing gap or sensing head to different types of yarn or thread is not necessary; the apparatus will operate equally well with heavy as well as with thin thread, composite or monofilamentary thread, and errors due to changes in thread diameter, quality, characteristics (such as moisture) will not interfere with proper operation.

Figure 3:
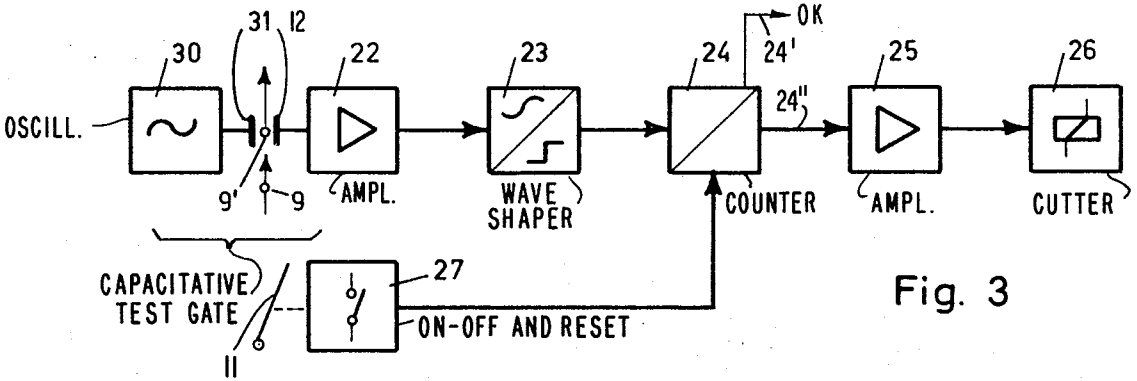
FIG. 3 is another embodiment of an electrical circuit for the test and sensing device, in block diagrammatic form.

Various changes and modifications may be made. The test gate located on opposite sides of the gap 12 need not be an optical gate, as shown in FIG. 2. The optical gate 20, 21 can be replaced by other sensors or transducers. Preferably, LED 20 operates in the infrared region. An LED may be used which provides essentially monochromatic light; the photosensitive pick-up 21 (which may also be a photo diode) can be matched to have maximum spectral sensitivity at the emission range of the LED 20. Another transducer is illustrated in FIG. 3, in which, instead of the optical gate of FIG. 2, a capacitative system is provided. An oscillator 30 provides high-frequency oscillations to a pair of capacitor plates 31, located on either side of the measuring gap 12. The threads 9, 9' pass through the plates of the capacitor, thus changing the output from the oscillator, which change, as amplified in amplifier 22, is sensed by the wave shaper 23 to provide a square-wave output, to again be counted in counter 24 as previously explained. If a plurality of threads pass through the plates 31 between which the test gap 12 is defined, a plurality of pulses will be generated, proportional to the number of threads passing therethrough.

The sequence of operations is explained in the attached table.

The output signal from the counter 24, if other than ONE, when the arm 11 is in its extreme right-hand position, can be applied to a further counter, besides being applied to the search initiation control which re-initiates a new pick-up operation by movement of the link 8 after the arm 11 has returned to the left-hand, initial position. The additional counter then counts the number of repeat operations necessary until only a single thread 9 is detected, that is, until counter 24 records only a count of ONE. If the number of repeat operations exceeds a predetermined value, for example three, then the additional counter stops further search or pick-up operations, and provides an alarm signal. Additionally, the state of the counter can be used when the count state is further related to the identification of particular spooling positions, to provide statistical information regarding the quality of operation of the pick-up, defect-sensing and clearing mechanism, and the specific spooling positions of a multiple spindle spooling machine.

TABLE.

Sequencing of defect-sensing and clearing:

A. Sensing absence of continuous yarn spooling (for example by stop motion device, not shown).

B. Start vacuum nozzle 6, and move linkage 8 to left. Bail 13 raised, arm 11 at extreme left.

C. Links 8 and nozzle 6 at extreme left.

D. Return movement of links 8 and nozzle 6; thread 9, 9' (if present) sucked into nozzle 6, and being withdrawn upon right-directed movement of links 8 and nozzle 6.

E. Nozzle 6 at extreme right position (see FIG. 1); vacuum continues.

F. Bail 13 drops to position shown in FIG. 1.

G. Arm 11 swings towards right, moving test gap 12 transverse to threads; simultaneous with initiation of movement of arm 11, switch 27 (FIG. 2) closes, counter 24 energized.

H. At extreme right end of travel of arm 11, switch 27 opens, count in counter 24 sensed and transferred:

1. if count is ONE, output providing an "OKAY" or "KNOT" command on line 24', return of arm 11 to left position, and initiation of further operation on thread 9.
2. If count is ZERO, retraction of arm 11 to extreme left position, bail 13 raises, and re-cycling of operation starting at (B) above.
3. If count in counter 24 is greater than ONE, cutter 26 energized, arm 11 swings to extreme left, bail 13 raised, and re-cycling of operation commencing at (B) above.
4. Optionally, if count in counter 24 is not ONE, retraction of arm 11 to extreme left position, bail 13 is raised, and alarm signal to supervisory personnel.

I. - Optional: Counting of re-cycling operations in case of (H)–(2) or (3) above, and limiting of re-cycling operations to a predetermined number, with alarm signal to supervisory personnel when the limit number has been reached; optionally, recording of number of re-cycling operations, and of particular spooling position involved.

I claim:

1. Apparatus to test for the presence of one only discrete strand of thread being picked up from a yarn supply comprising means (10, 10') defining a test gap (12);

means (6, 7) picking up thread from the supply and placing it in the test gap;

means (20, 21; 30, 31) sensing the presence of thread (9, 9') in the test gap (12) and providing an output signal each time when the presence of a discrete strand of thread (9, 9') in said test gap is being sensed, and a counter (24) controlled by the output signals from the sensing means, and algebraically counting the number to discrete threads (9, 9') passing through the test gap (12), the counter (24) providing an output signal when the count number is other than a predetermined value.

2. Apparatus according to claim 1, wherein the counter provides an output control signal when the count number exceeds unity.

3. Apparatus according to claim 1, further comprising a thread cutter (26) located with respect to the threads to cut the threads, and controlled by an output from the counter (24), if the count number exceeds unity.

4. Apparatus according to claim 1, further comprising means (11) movably supporting the test gap defining means (10, 10') and moving said test gap defining means in a direction having a vector component extending transversely to the major directions of the threads being picked up.

5. In automatic thread spooling machines, defect sensing and clearing mechanism (2), comprising pick-up means (6, 7) picking up loose thread ends from spools (4) on the spooling machine;

means (10, 10') defining a test gap (12);

means (20, 21; 30, 31) sensing presence of thread in the test gap;

means (11) movably supporting the test gap defining means (10, 10') for movement essentially transverse to the major directions of the threads which have been picked up by said pick-up means (6);

counter means (24) connected to and controlled by said sensing means to count the number of discrete strands of thread sensed by said sensing means upon relative movement between the thread and the test gap defining means; and means (24'; 25, 26) evaluating the count of the counter means.

6. Spooling machine according to claim 5, further comprising a thread cutter (26) located transversely to threads leading to the pick-up means (6) and operated and controlled by the means evaluating the count from the counter (24) if the count is other than ONE.

7. Spooling machine according to claim 6, wherein the means defining the test gap comprises a sensing head having an open and a closed end, movable essentially transversely to the major extent of the threads to an extreme position in which any thread being picked up is located at the closed end;

and wherein the cutter means (26) is located adjacent the closed end of the sensing head, to cut all threads adjacent said closed end.

8. Spooling machine according to claim 5, further comprising means (2') to re-initiate activation of said pick-up means (6) when a count other than ONE is sensed by said count evaluation means.

9. Spooling machine according to claim 5, wherein the sensing means is an optical gate (20, 21).

10. Spooling machine according to claim 5, wherein the sensing means comprises an oscillator (30) and spaced capacitor plates (31) connected to the oscillator, the space between said plates forming said test gap.

11. Spooling machine according to claim 5, further comprising OFF switch means (27) disabling and resetting the counter after movement of the means defining the test gap transverse to the major extent of the threads.

* * * * *